US006705630B1

(12) United States Patent
Karpman

(10) Patent No.: US 6,705,630 B1
(45) Date of Patent: Mar. 16, 2004

(54) PERSONAL VEHICLE

(76) Inventor: Alon Karpman, 525 Fifth Ave., 23rd Floor, New York, NY (US) 10017

( * ) Notice: Subject to any disclaimer, the term of this patent is extended or adjusted under 35 U.S.C. 154(b) by 0 days.

(21) Appl. No.: 10/227,651

(22) Filed: Aug. 23, 2002

(51) Int. Cl.[7] ..... B62M 1/00
(52) U.S. Cl. ..... 280/253; 280/258; 280/257
(58) Field of Search ..... 280/87.041, 87.043, 280/220, 221, 252, 253, 256–258

(56) References Cited

U.S. PATENT DOCUMENTS

| | | | | | |
|---|---|---|---|---|---|
| 4,186,934 | A | * | 2/1980 | Collings | 280/221 |
| 4,761,014 | A | * | 8/1988 | Huang | 280/258 |
| 4,861,054 | A | * | 8/1989 | Spital | 280/221 |
| 4,861,055 | A | | 8/1989 | Jones | 250/234 |
| 5,280,935 | A | | 1/1994 | Sobocan | 280/221 |
| 5,419,619 | A | | 5/1995 | Lew | 301/5.1 |
| 5,490,719 | A | | 2/1996 | Lew | 301/5.1 |
| 5,975,229 | A | | 11/1999 | Hosoda | 180/181 |
| 5,992,864 | A | | 11/1999 | Dickson | 280/87.041 |
| 6,079,727 | A | | 6/2000 | Fan | 280/265 |
| 6,189,907 | B1 | * | 2/2001 | Nelson et al. | 280/258 |
| 6,206,389 | B1 | | 3/2001 | Yagi | 280/87.042 |
| 6,241,269 | B1 | * | 6/2001 | Fan | 280/265 |
| 6,338,494 | B1 | | 1/2002 | Killian | 280/87.042 |
| 6,357,544 | B1 | | 3/2002 | Kamen | 180/218 |
| 6,398,237 | B1 | | 6/2002 | Attey | 280/87.042 |
| 6,398,244 | B1 | * | 6/2002 | Chueh | 280/221 |
| 6,405,816 | B1 | | 6/2002 | Kamen | 180/65.1 |
| 6,419,251 | B1 | * | 7/2002 | Chueh | 280/221 |

FOREIGN PATENT DOCUMENTS

| | | | |
|---|---|---|---|
| WO | WO 00/75001 A1 | 12/2000 | 180/65.1 |

* cited by examiner

*Primary Examiner*—Lesley D. Morris
*Assistant Examiner*—L. Lum
(74) *Attorney, Agent, or Firm*—Meredith & Keyhani, PLLC; Jennifer Meredith, Esq.

(57) ABSTRACT

The present invention provides an easy turning and highly accurate personal vehicle. This is accomplished by providing a frame with at least one hubless wheel, wherein the passenger's foot may be contained. As such, the foot may accurately and safely steer and at the same time provide support. According to a preferred embodiment, there may be a frame, a first wheel with a first foot support in a center portion and a second wheel with a second foot support in a center portion. Also, there may be a human powered drive mechanism that allows the foot to be in the center portion of the wheel and yet still capable of providing human power to the personal vehicle. In this way a human powered, stable, highly accurate and fast personal vehicle is achieved as never previously accomplished within the art.

35 Claims, 6 Drawing Sheets

PERSONAL VEHICLE

BACKGROUND OF THE INVENTION

The present invention generally relates to personal vehicles including self-propelled stand-on personal vehicles. Numerous personal vehicles are known within the art. These may include bicycles, rollerblades, skateboards and the like. Stand-on transportation devices are also known within the art. By way of example, U.S. Pat. No. 5,975,229 issued to Hosoda, discloses a stand-on transportation device with shafts to which the front wheel and the rear wheel are assembled and the frame connects these shafts. The rider is support by a footboard along the frame.

Also, known within the art are foot driven vehicles. By way of example, U.S. Pat. No. 6,079,727 issued to Fan discloses a foot driven vehicle. The '727 patent discloses the use of a foot pedal along a frame portion and connected to a crank. However, the '727 patent and similar devices do not provide stability at higher speeds. Cranking the foot pedal while traveling at high speeds and remaining stable would be difficult and dangerous, with the passenger risking falling off and injury.

Another foot driven vehicle is U.S. Pat. No. 4,761,014, issued to Huang. The '014 patent discloses a scooter with a ratchet mechanism for driving the rear wheel of the scooter, a stepping lever for transferring the stepping force of the rider to the ratchet mechanism and a retrieving means for raising the stepping lever as the stepping force is released. In this way the scooter can be propelled by the intermittent stepping force of the rider to advance forwardly. However, such a system is unstable at higher speeds. Also, it is difficult to coast and step on the lever at the same time. This results in the need to remove your foot from the lever, which can be unstable and cause the passenger to slow.

Also known within the art is The Wheelman. The Wheelman is a complicated, cumbersome, heavy, large, and expensive motorized personal vehicle. Because of the motorized nature of The Wheelman, it is loud, not safe for younger children, produces emissions, and is cost prohibitive.

Another disadvantage of the prior art, is the inability to mimic surfing and snowboarding. All previous devices have tried to mimic the surfing and snowboarding feel on land but are merely skateboards with somewhat of a surfing or snowboarding feel. In both snowboarding and surfing the riders feet are on the board at all times. None of these previous devices have allowed a rider to keep both feet on the device during propulsion, while retaining rider control and the feel of snowboarding or surfing.

Accordingly, what is needed is a stable, easy to turn device that may be human powered, remain stable at higher speeds and allow the rider to keep both feet on the device while providing a drive mechanism.

SUMMARY OF THE INVENTION

One aspect of the present invention is a personal vehicle for carrying a passenger, with a frame and at least two wheels rotatably attached to the frame. At least one wheel may have a foot support in a center portion of the wheel. There may also be a drive mechanism, so as to allow a passenger to have their foot on the foot support, yet provide power such as to rotate at least one of the wheels of the vehicle.

According to another aspect of the present invention, a personal vehicle for carrying a passenger is disclosed comprised of a frame and at least two wheels wherein at least one of the wheels is a hubless wheel comprised of a rotationally stationary inner rim, an outer rim and at least two bearings. The inner rim may be in communication with the frame. The outer rim may have an outside surface and a bearing engaging surface in communication at least two bearings. There may also be at least one foot support in a center portion of the hubless wheel.

According to a further aspect of the present invention, a personal vehicle for carrying a passenger is disclosed comprising a frame, a first wheel, a first foot support, a second wheel, and a second foot support. The first wheel may be comprised of a rotationally stationary inner rim, a rotatable outer rim and at least two bearings. The inner rim may be in communication with the frame. The outer rim may have an outside surface and a bearing engaging surface in communication with at least two bearings. The first foot support may be in a center portion of the first wheel and in communication with the inner rim of the first wheel. The first wheel may have a horizontal axis. The first foot support may have a centerline substantially perpendicular to this horizontal axis. There may also be a second wheel with at least two bearings, a rotationally stationary inner rim and a rotatable outer rim with a bearing engaging surface and an outside surface. The inner rim may be in communication with the frame. At least two bearings may be in communication with the bearing engaging surface of the second wheel. A second foot support may be in a center portion of the second wheel and in communication with the inner rim of the second wheel. The second wheel having a horizontal axis and the second foot support having a centerline substantially perpendicular to the horizontal axis. A drive mechanism comprised of a lever, a spring device, and at least one gear may cause the vehicle to move in a forward or backward motion. The lever may be substantially horizontal and move in an up and down motion. The spring device may effectuate substantially linear movement of the lever. Alternatively, the spring device may effectuate substantially linear movement of a support, which in turn moves the lever. At least one gear translates and amplifies the linear movement of the lever, to provide rotational force. This rotational force may be utilized to turn another gear, or turn at least one wheel.

According to yet another embodiment, a personal vehicle for carrying a passenger is disclosed comprising a frame, a first wheel, a first foot support, a second wheel, a second foot support, and a human powered drive mechanism. The first wheel may have a horizontal axis and be comprised of a rotationally stationary inner rim, a rotatable outer rim and at least two bearings. The inner rim may be in communication with the frame. The rotatable outer rim may have an outside surface and a bearing engaging surface, wherein the bearing engaging surface may be in communication with at least two bearings. The first foot support may be in a center portion of the first wheel and have a centerline and a lateral axis. The lateral axis being at an angle between 0 and 45 degrees from the horizontal axis of the first wheel and the centerline being substantially perpendicular to the horizontal axis of the first wheel. The second wheel may have a horizontal axis and be comprised of a rotationally stationary inner rim, a rotatable outer rim and at least two bearings. The inner rim is in communication with the frame. The rotatable outer rim having an outside surface and a bearing engaging surface in communication with at least two bearings. A second foot support may be in a center portion of the second wheel and have a centerline and a lateral axis. The second foot support may move so that lateral axis moves at an angle relative to the horizontal axis of the second wheel between 0 and 80 degrees. The centerline of the second foot support may be substantially perpendicular to the horizontal axis of the second wheel. The human powered drive mechanism comprised of a lever, a spring device, an engagement slip, a first gear, a second gear and a protruding gear. The lever may be substantially parallel to a horizontal axis of the second wheel and in communication with a second foot support. The spring device may be in communication with the second support. The engagement slip may be in communication with the lever. The first gear may be in rotating communication with the engagement slip. The second gear may be in communication with the first gear and a protruding gear. The protruding gear being fixedly attached to the inner rim of the second wheel.

According to still yet another embodiment, a method of providing a stable, easy to turn personal vehicle is disclosed. This method includes the steps of coupling an inner rim of a hubless wheel to a frame, wherein the hubless wheel has a center portion; providing a movable foot support in a center portion of a hubless wheel, which may move in a stepping motion; providing a lever in communication with the movable foot support to translate stepping motion into a rotational force; providing a first gear in communication with the lever to translate and amplify rotational force; and providing a protruding gear to translate rotational force and turn the hubless wheel. A number of different gears may be utilized to amplify and translate rotational force.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention discloses a personal vehicle for carrying a passenger. This may be for recreational purposes. Also, it may be utilized to replicate snowboarding, as in the case of off-season training. This vehicle may comprise a frame and at least two wheels rotatably attached to the frame. At least one wheel may have a foot support in a center portion of at least one wheel. It should be understood that many different embodiment are envisioned. There may be a standard wheel, and a hubless wheel with a foot support in the center. Many different combinations are claimed and disclosed herein.

Figure 1A:
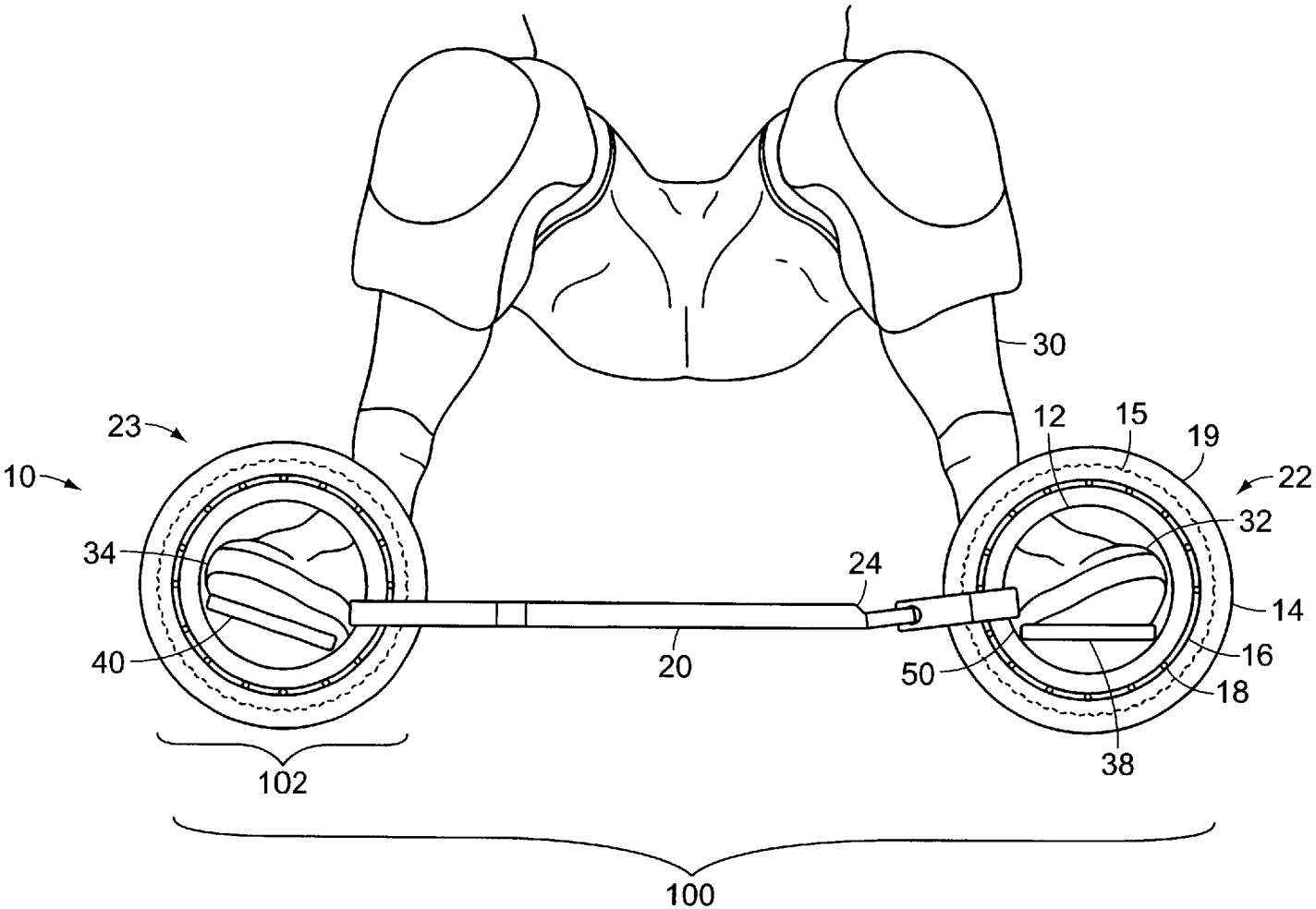
FIG. 1A is a side view of a personal vehicle according to an embodiment of the present invention.

FIG. 1A depicts a vehicle 10 according to the present invention. The wheels 22 and 23 be hubless. As depicted by wheels 22 and 23, there may be a rotationally stationary inner rim 12, a rotatable outer rim 15 and bearings 18. The outer rim 15 having a bearing engaging surface 16 and a outside surface 14. There may be a removable tire 19 in communication with the outside surface 14. There should be at least two bearings 18 in sliding communication with the bearing engaging surface 16 of outer rim 15 of the wheel 22 of the vehicle 10. The bearings 18 allow the rotatable outer rim 15 to rotate around the rotationally stationary inner rim 12. The rotationally stationary inner rim 12 may be attached to a portion of frame 20. The frame 20 may also have a pivot 24 to allow the vehicle 10 to turn. As shown, there may be a passenger 30 with a front foot 32 and a back foot 34. The front foot 32 may be in communication with a foot support 38. The foot support 38 may be supported by the rotationally stationary inner rim 12. There may also be a back foot support 40 which may be in communication with back foot 34 so as to provide support for passenger 30.

Figure 1B:
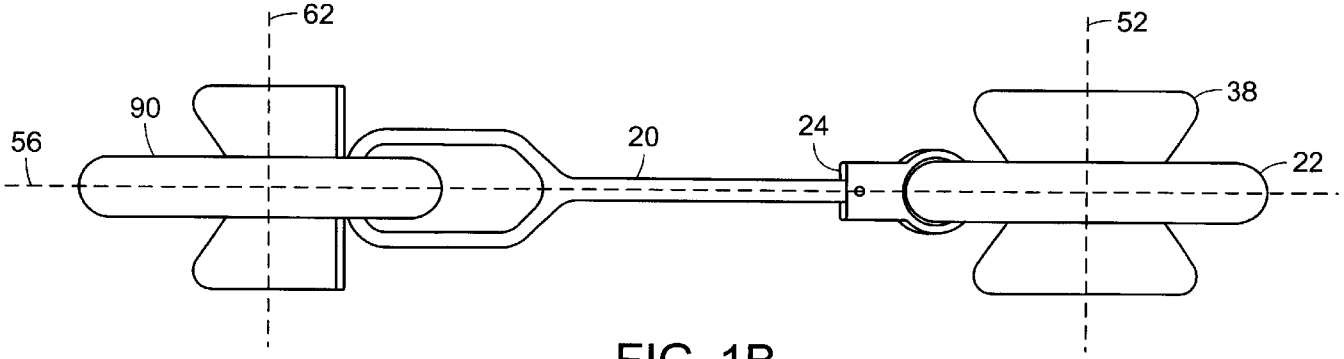
FIG. 1B is a bottom view of a personal vehicle according to an embodiment of the present invention.

FIG. 1B depicts a bottom view of vehicle 10 according to the present invention. As shown, the centerline 52 of foot support 38 may be substantially perpendicular to horizontal axis 56. By substantially perpendicular it is intended that the foot support 38 support the foot 32 in such a manner that the foot 32 be in a position similar to that of snowboarding or skateboarding, yet be in the center portion 60 of the wheel 22. The centerline 62 of foot support 40 is also substantially parallel to horizontal axis 56. Also, shown is pivot 24, which allows the vehicle 10 to turn. The wheel 22 may turn 175 degrees in either direction from the centerline 56. The wheel 23, according to this embodiment does not turn along the centerline 56.

It should be noted that there may also be only one foot support without departing from the present invention. By way of example, there may be foot support 38 which supports front foot 32 and the back foot 34 may be supported on a portion of the frame 20. According to another embodiment, there may be a back foot support 40 in communication with a back foot 34 and the front foot 32 may rest upon a portion of the frame 20. There may also be a pivot 24, to allow a wheel 22 to pivot relative to another wheel 23. There may also be a folding mechanism along the frame 20, without departing from the present invention, so as to fold the vehicle for easy carrying and storage.

Figure 2A:
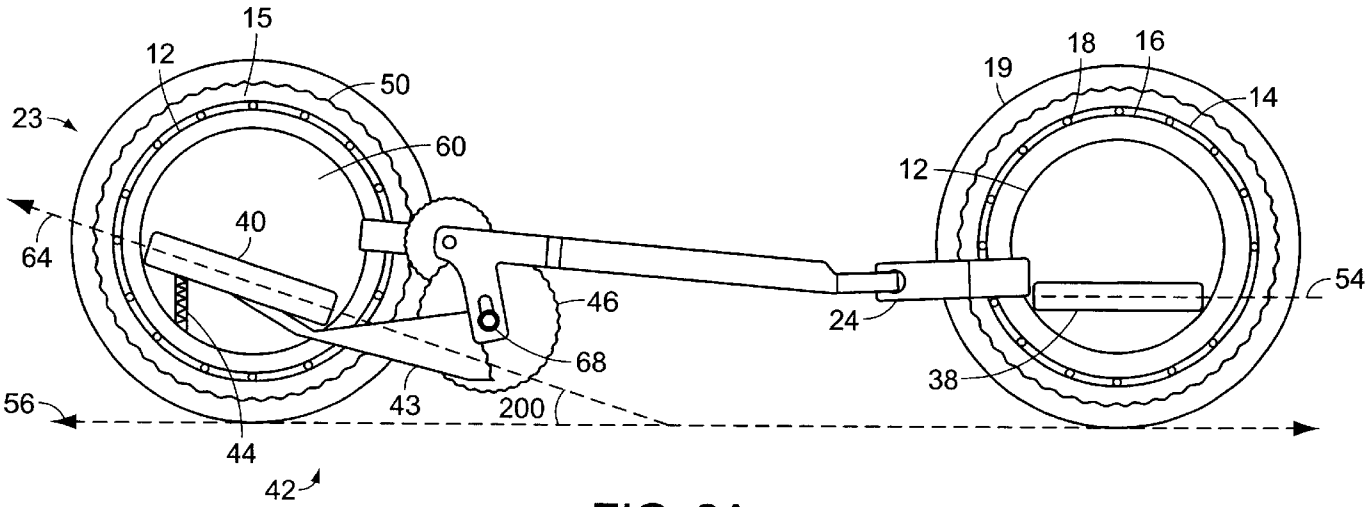
FIG. 2A is a side view of a personal vehicle with a human powered drive mechanism according to the present invention.

As shown in FIG. 2A, there may also be a human powered drive mechanism 42 which allows the passenger 30 to move the vehicle 10 in a substantially linear motion forwards or backwards and accurately turn the vehicle. The back foot support 40 may be within the center portion 60 of a wheel 23. The support 40 may be depressed by back foot 34, which in turn depresses the lever 43. A spring 44 may be attached to the inner rim 12, so as to allow the passenger to pump the foot support 40 in an up and down motion. The foot support 40 may have a lateral axis 64. The back foot 34, may depress the support 40, which has the spring 44 placing an upward pressure on the support 40, so that the back foot may pump or move up and down the support 40. The angle 200 of the lateral axis 64 relative to the horizontal axis 56 of the wheel may be between 0 and 60 degrees, preferably 30 degrees. The support 40 is in communication with the lever 43 and causes the lever 43 to move in a substantially linear up and down motion. The lever 43 is in communication with engagement slip 68, which is in turn in communication with first gear 46. The engagement slip 68 allows stepping force of lever 43 to be continuously translated and amplified. When the lever 43 is depressed the engagement slip 68 engages the first gear 46 to cause the rotation of the first gear 46. When the lever 43 is released, as may occur when the spring 44 causes the lever 43 to return to a starting position, the engagement slip 68 disengages the first gear 46. The first gear 46 may then engage the second gear 48, which in turn engages the protruding gear 50. The protruding gear 50 is attached to the outer rim 15 and causes the outer rim 15 of the wheel 23 to turn. The foot support 38 may also have a lateral axis 54 which may be at an angle relative to the horizontal axis 56 of the wheel 22. The angle may be between 0 and 45 degrees, preferably less than 10.

Referring to FIGS. 1–2A, and by way of providing an example, the length 100 of the vehicle 10 may be between two and five feet, preferably 3 feet 5 inches. The outer rim 15 may have an outer diameter 102 of between 8 and 16 inches, preferably 9 inches. The inner rim 12 may have an outer diameter between 4 inches and 14 inches, preferably 8 inches. The bearings may have a width of ⅜ inches, with an inner diameter of 3⁄16, and an outer diameter of 11⁄32 inches and a 3⁄16 inch diameter stem. As discussed supra, the stepping force, by the passenger, to a lever 43, may be translated to a number of gears. In the example shown, the lever 43 may be 6 inches long and be in communication with the substantially circular first gear 46, wherein the first gear 46 may have an outer diameter between 2 inches and 10 inches, preferably 4 inches. The linear motion of the lever 43 may be transferred into an rotating motion by first gear 46, which may in turn cause a second gear 48 to rotate. The second gear 48 may be between 1 and 8 inches, preferably 3 inches. The second gear 48 may be in communication with a protruding gear 50 which may be a part of or attached to the outer rim 15. In this way, the liner motion up and down, or stepping motion of the passenger, may be translated to the lever 43, a first gear 46, a second gear 48, and finally a protruding gear 50 attached to the outer rim 15 of the wheel 22. It should be noted that the lever 43 may also be located along the frame 20. In this way the user may pump the lever, yet coast or cruise with their feet supported by at least one foot support in a center portion of at least one wheel.

Figure 2B:
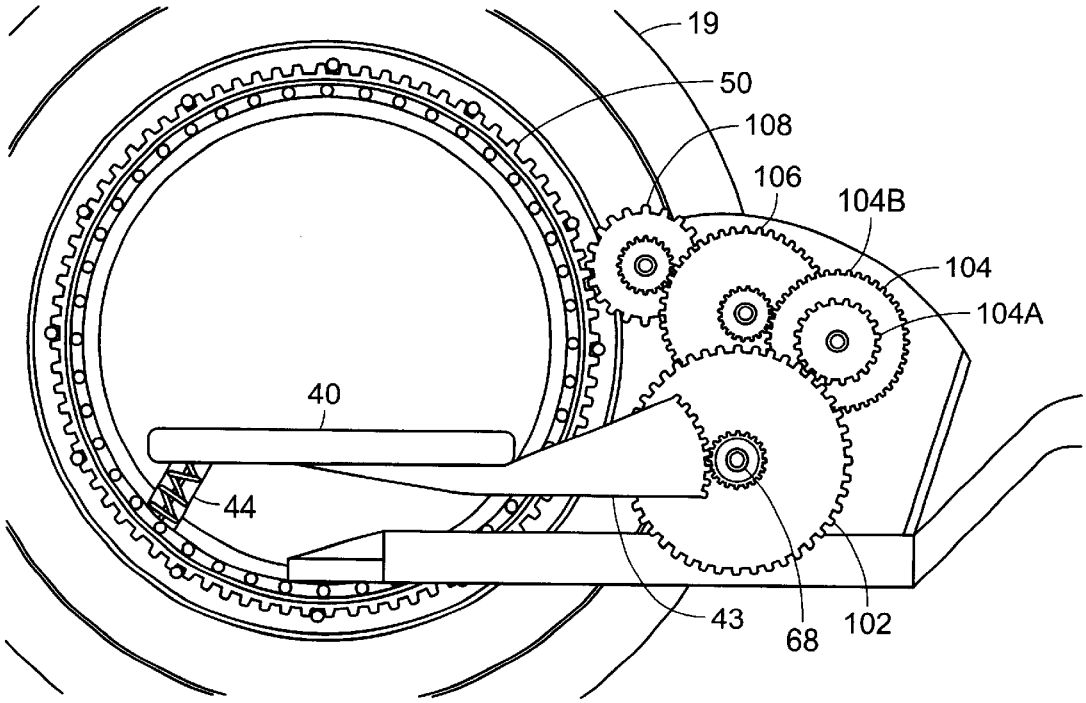
FIG. 2B is a side view of a personal vehicle with a human powered drive mechanism according to the present invention.

FIG. 2B depicts an alternate embodiment of the gears according to the present invention. Pressure on the foot support 40 causes the lever 43 to angularly move and cause the engagement slip 68 to engage the first gear 102 and rotate the first gear 102. The first gear 102 engages a second gear 104, which engages a third gear 106, which engages a fourth gear 108, which turns protruding gear 50. The protruding gear 50, or any other engaging device known within the art, may be along the outer rim 15 or against a tire 19. Any of the gears may be in direct contact with another gear, or as shown by second gear 104, the first gear 102 may engage an inner portion 104*a* of second gear 104 and an outer portion 104*b* of second gear 104 may make contact with the third gear 106. Where there is no downward pressure placed on the engagement slip 68, it will disengage and the spring 44 may cause the lever 43 to return to initial position. In this way, the lever 43 can constantly translate and cause the first gear 102 to rotate as long as there is an up and down, or stepping force on the lever 43. When there is not a downward pressure on the lever 43, the engagement slip 68 will be disengaged. In this way, it is possible to continuously drive the gears and in turn the vehicle.

The first gear 102 causes the rotation of a second gear 104. Depending on the size of the gears relative to one another, the gear may amplify and translate the rotational force of one gear relative to another. It should be understood that a number of different gear types and sizes may be utilized without departing from the present invention.

Figure 3:
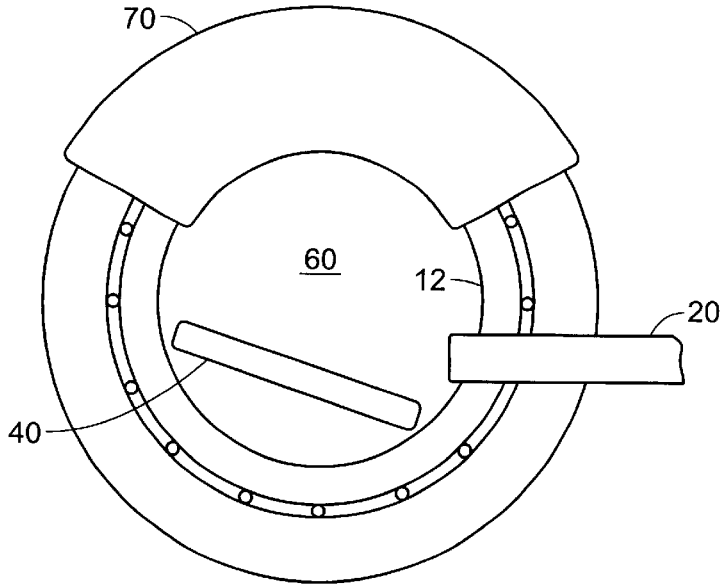
FIG. 3 is side view of a personal vehicle with a tire shield.

As shown in FIG. 3, there may also be at least one tire shield 70. The tire shield 70 may serve many purposes. It may shield the passenger from any moving gears and the moving tire. Also, the tire shield 70 allows the passenger to steer using not only their foot, but their shin, ankle or any other portion of the leg. This enables the passenger to turn at higher speeds, while remaining stable. This is because the tire shield may provide added support to the passenger along their ankle, shin or any other portion of the leg or foot. The tire shield 70 may be attached to the inner rim 12 and above the foot support 40 and frame 20. The passengers foot may then be in the center portion 60 and utilize the tire shield 70 to steer the vehicle.

Figure 4:
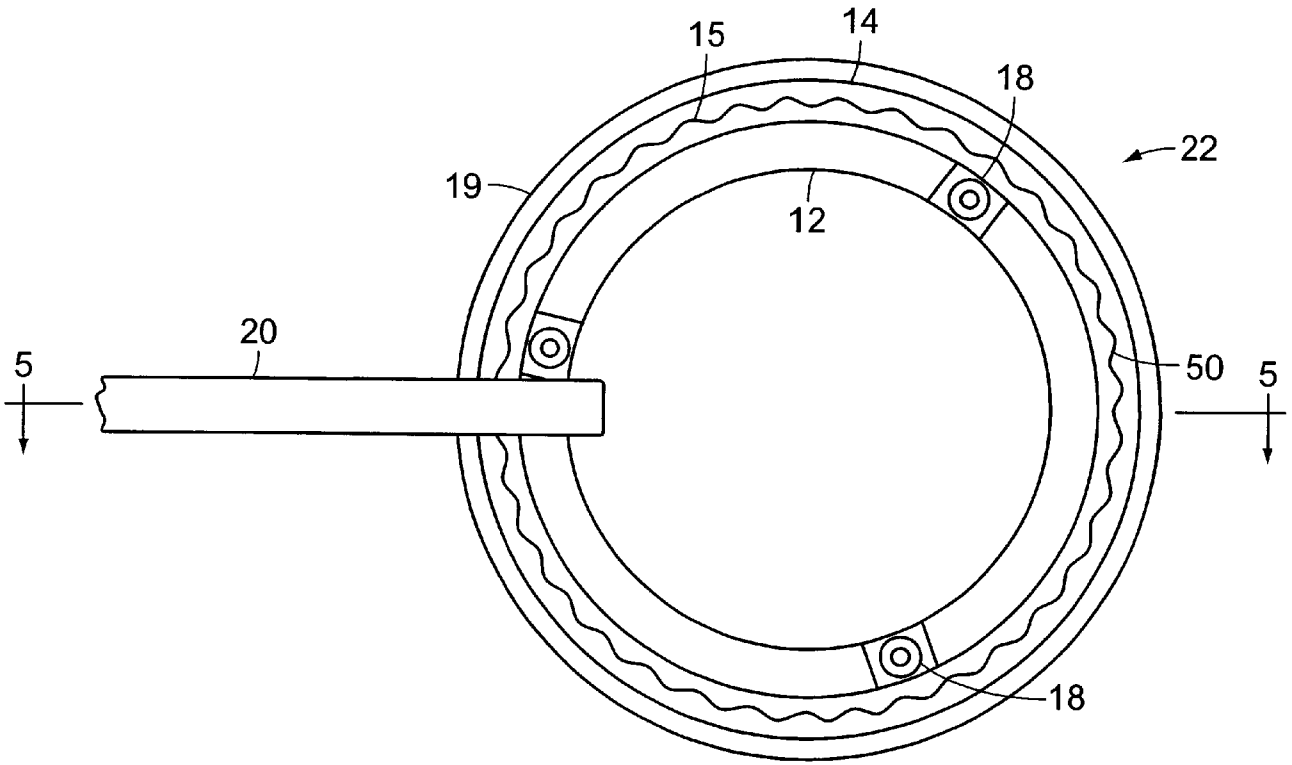
FIG. 4 is a side view of a hubless wheel detached from the vehicle.

For explanation purposes, wheel 22 is shown in FIG. 4 removed from vehicle 10. Wheel 22 may be comprised of frame 20, a rotationally stationary inner rim 12, and a rotatable outer rim 15. Frame 20 may be attached to inner rim 12 such that the inner rim 12 does not revolve or otherwise experience rolling rotation during vehicle 10 operation. The inner rim 12 may be attached to the frame 20 by any means known within the art including screws, welding, composites and the like. The inner rim 12 may also be fabricated so as to provide a solitary piece that has both an inner rim 12 portion and a frame 20 portion. The outer rim 15 may freely rotate around the inner rim 12, along the bearing engaging surface and provides the outside surface 14. A removable tire 19 may in communication or attached to the outside surface 14. A protruding gear 50 may be a part of or attached to the outer rim 15.

Figure 5:
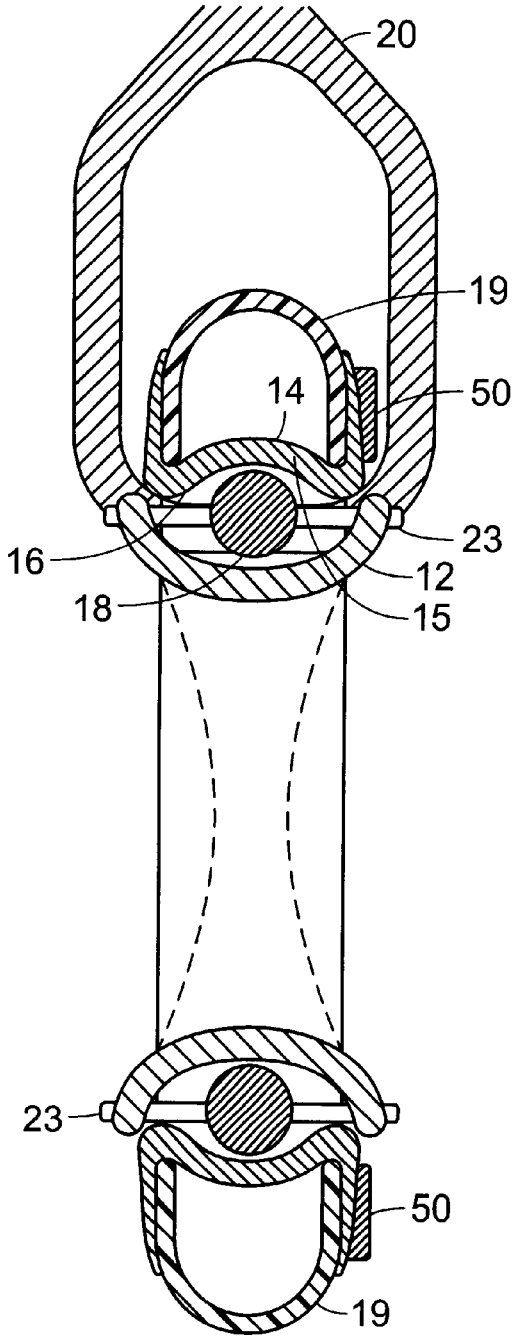
FIG. 5 is a radial partial cross-sectional view, taken along line 5—5 of FIG. 4.

Referring now to FIG. 5, outer rim 15 includes an outside surface 14 which may be in communication with replaceable tire 19. The outer rim 15 may have the inner rim 12 on one side and freely rotate within the frame 20. Along the outer rim 15 may be the protruding gear 50 which also freely rotates within the frame 20. The protruding gear 50 may be in communication with a drive mechanism (not shown) so as to turn the wheel. The drive mechanism may be human powered or any combustion electric or fuel cell engine known within the art. The bearing engaging surface 16 is in communication with at least two bearings 18, and the bearings are fixedly attached to the inner rim 12. The bearings 18 may be fixedly attached to the inner rim 12 by a stem 23. There must be at least two bearings 18, and preferably four bearings. The bearings 18 may have a width of ⅜ inches and an outer diameter of 11⁄32 inches. The stem 23, according to a preferred embodiment, is 3⁄16 of an inch in diameter. The stem 23 may be assembled to go through the bearings 18 and the inner rim 12, so as to allow the bearings 18 to freely rotate, yet be fixed to the inner rim 12. The bearings 18 allows the outer rim 15 to rotate.

Outer rim 15 is fabricated to provide a high strength, yet low weight exterior shell. The frame 20 and outer rim 15 may be made of a composite. The term "composite" refers to the product resulting from the application to a binder of a liquid which cures to a solid. In a preferred construction, frame 20 is made of aluminum. The inner rim 12 may be made of composite or steel and the outer rim 15 may be made of composite or steel. Exterior shell of outer rim 15 is a composite. Various composites, carbon fiber, Kevlar™, boron fiber and glass fiber may also be applied as a binder to various portions of the present invention to provide stability and are intended to be within the scope of the present invention.

Figure 6:
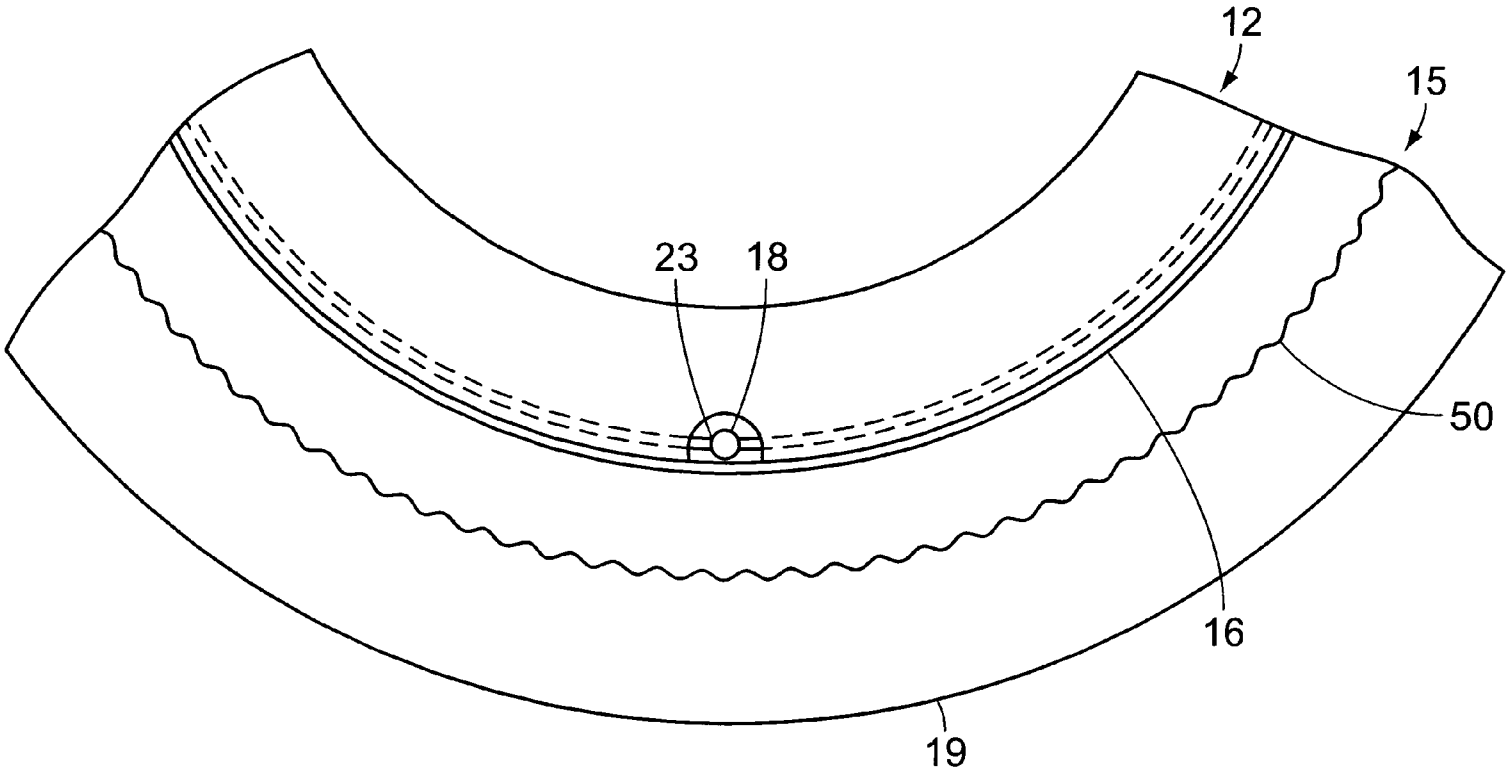
FIG. 6 is a detailed side view of a hubless wheel according to a preferred embodiment of the present invention.

FIG. 6 depicts a side view of a preferred embodiment according to the present invention. As shown, the protruding gear 50 may be attached to the outer rim 15. A tire 19 may be attached to the outer rim 15, which rotates around the inner rim 12 according to a groove along the bearing engaging surface 16. The stem 23 may secure the bearing 18 to the inner rim 12.

It is envisioned that any enhancement device known within the art may be utilized without departing from the present invention. For example, reflectors, brake, handlebars, lights, a speedometer, an odometer may all be added to the vehicle.

The present invention also envisions a method of providing a stable, easy to turn personal vehicle. This method includes the steps of coupling an inner rim of a hubless wheel to a frame, wherein the hubless wheel has a center portion; providing a movable foot support in a center portion of a hubless wheel, which may move in a stepping motion; providing a lever in communication with the movable foot support to translate stepping motion into a rotational force; providing a first gear in communication with the lever to translate and amplify rotational force; and providing a protruding gear to translate rotational force and turn the hubless wheel. A number of different gears may be utilized to amplify and translate rotational force. The method may also comprise the step of providing a second foot support in a center portion of a second hubless wheel for added steering the vehicle.

It should be understood, of course, that the foregoing relates to preferred embodiments of the invention and that modifications may be made without departing from the spirit and scope of the invention as set forth in the following claims.

I claim:

1. A personal vehicle for carrying a passenger, said vehicle comprising:

a frame;

at least two wheels rotatably attached to said frame, wherein at least one wheel has a foot support in a center portion of said wheel; and a drive mechanism in communication with at least one wheel, wherein said drive mechanism is human powered and comprised of a lever, at least one gear in rotational communication with said lever and in rotational communication with at least one wheel of said at least two wheels.

2. A personal vehicle as in claim 1, further comprising an engagement slip in communication with said lever and said at least one gear.

3. A personal vehicle as in claim 1, wherein said at least one gear of said drive mechanism is a protruding gear fixedly attached to at least one wheel.

4. A personal vehicle as in claim 1, wherein said at least two wheels have a horizontal axis and said foot support has a centerline, said centerline being substantially perpendicular to said horizontal axis.

5. A personal vehicle as in claim 1, wherein said at least two wheels have a horizontal axis and said foot support has a lateral axis, said lateral axis being at an angle between 0 and 45 degrees from said horizontal axis.

6. A personal vehicle as in claim 1, wherein said at least one wheel is comprised of:

a rotationally stationary inner rim in communication with said frame;

a rotatable outer rim with a bearing engaging surface and a outside surface; and at least two bearings in contact with said bearing engaging surface.

7. A personal vehicle as in claim 6, further comprising a tire shield attached to said inner rim.

8. A personal vehicle as in claim 6, further comprising a removable tire in communication with said outside surface.

9. A personal vehicle for carrying a passenger, said vehicle comprising:

a frame;

at least two wheels wherein at least one of said at least two wheels is a hubless wheel comprised of a rotationally stationary inner rim, an outer rim and at least one bearing, wherein said inner rim is in communication with said frame, and said outer rim has a outside surface and a bearing engaging surface in communication with said at least one bearing; and at least one foot support in a center portion of said hubless wheel.

10. A personal vehicle as in claim 9, wherein said at least two wheels have a horizontal axis and said at least one foot support has a centerline, said centerline being substantially perpendicular to said horizontal axis.

11. A personal vehicle as in claim 9, wherein said at least two wheels have a horizontal axis and said at least one foot support has a lateral axis, said lateral axis being at an angle between 0 and 45 degrees from said horizontal axis.

12. A personal vehicle as in claim 9, further comprising a tire shield attached to said inner rim.

13. A personal vehicle as in claim 9, further comprising a removable tire in communication with said outside surface.

14. A personal vehicle as in claim 9, further comprising a drive mechanism in communication with at least one wheel.

15. A personal vehicle as in claim 9, wherein said drive mechanism is human powered and comprised of:

a lever;

at least one gear in rotational communication with said lever;

and a protruding gear in rotational communication with one of said at least one gear, wherein said protruding gear is fixed to a portion of said inner rim of at least one wheel of said at least two wheels.

16. A personal vehicle as in claim 15, further comprising an engagement slip in communication with said lever and said at least one gear.

17. A personal vehicle as in claim 15, wherein said at least one gear of said drive mechanism is a protruding gear fixably attached to at least one wheel.

18. A personal vehicle as in claim 15, wherein said drive mechanism is chosen from the group consisting of a combustion, electric or fuel engine.

19. A personal vehicle for carrying a passenger, said vehicle comprising:

a frame;

a first wheel comprised of a rotationally stationary inner rim, a rotatable outer rim and at least two bearings, wherein said inner rim is in communication with said frame and said outer rim has a outside surface and a bearing engaging surface in communication with said at least two bearings, a first foot support in a center portion of said first wheel and in communication with said inner rim of said first wheel, said first wheel having a horizontal axis and said first foot support having a centerline substantially perpendicular to said horizontal axis;

a second wheel comprised of a rotationally stationary inner rim, a rotatable outer rim with a bearing engaging surface, an outside surface and at least two bearings, wherein said inner rim is in communication with said frame and said at least two bearings is in communication with said bearing engaging surface;

a second foot support in a center portion of said second wheel and in communication with said inner rim of said second wheel, said second wheel having a horizontal axis and said second foot support having a centerline substantially perpendicular to said horizontal axis; and a drive mechanism comprised of a lever substantially parallel to a centerline of said frame, a spring device to effectuate substantially linear movement of said lever, an engagement slip in communication with said lever, and at least one gear in communication with said engagement slip.

20. A personal vehicle as in claim 19, wherein said first wheel has a horizontal axis and said first foot support has a lateral axis, said lateral axis being at an angle between 0 and 45 degrees from said horizontal axis.

21. A personal vehicle as in claim 19, wherein said second wheel has a horizontal axis and said second foot support has a lateral axis, said lateral axis being at an angle between 0 and 45 degrees from said horizontal axis.

22. A personal vehicle as in claim 19, further comprising a tire shield attached to said inner rim of said first wheel.

23. A personal vehicle as in claim 19, further comprising a tire shield attached to said inner rim of said second wheel.

24. A personal vehicle as in claim 19, further comprising a removable tire in communication with said outside surface.

25. A personal vehicle as in 19, wherein said lever is in communication with said first foot support and said first foot support is in communication with said spring device.

26. A personal vehicle as in claim 19, wherein said lever is in communication with said second foot support and said second foot support is in communication with said spring device.

27. A personal vehicle as in claim 19, wherein said at least one gear of said drive mechanism is a protruding gear fixably attached to at least one wheel.

28. A personal vehicle for carrying a passenger, said vehicle comprising:

a frame;

a first wheel having a horizontal axis and comprised of a rotationally stationary inner rim, a rotatable outer rim and at least two bearings, wherein said inner rim is in communication with said frame, said a rotatable outer rim has a outside surface and a bearing engaging surface in communication with at least two said bearings;

a first foot support in a center portion of said first wheel and having a centerline and a lateral axis, said lateral axis being at an angle between 0 and 45 degrees from said horizontal axis of said first wheel and said centerline being substantially perpendicular to said horizontal axis of said first wheel;

a second wheel having a horizontal axis comprised of a rotationally stationary inner rim, a rotatable outer rim and at least two bearings, wherein said inner rim is in communication with said frame, said a rotatable outer rim has a outside surface and a bearing engaging surface in communication with at least two said bearings;

a second foot support in a center portion of said second wheel and having a centerline and a lateral axis, said lateral axis angularly moves between 0 and 80 degrees from said horizontal axis of said second wheel and said centerline being substantially perpendicular to said horizontal axis of said second wheel;

a human powered drive mechanism comprised of a lever, a spring device, an engagement slip, a first gear, a second gear and a protruding gear, wherein said lever is substantially parallel to said horizontal axis of said second wheel and in communication with said second foot support, said spring device is in communication with said second support, said engagement slip is in communication with said lever, said first gear is in rotating communication with said engagement slip, said second gear being in communication with said first gear and said protruding gear, wherein said protruding gear is fixedly attached to said inner rim of said second wheel.

29. A personal vehicle as in claim 28, further comprising a foot support along said frame.

30. A personal vehicle as in claim 28, further comprising a tire shield attached to said first wheel.

31. A personal vehicle as in claim 28, further comprising a tire shield attached to said inner rim of said second wheel.

32. A personal vehicle as in claim 28, further comprising a removable tire in communication with said outside surface.

33. A method of providing a stable, easy to turn personal vehicle, comprising;

coupling an inner rim of a hubless wheel to a frame, wherein said hubless wheel has a center portion;

providing a movable foot support in a center portion of said hubless wheel, wherein said movable foot support moves in a stepping motion;

providing a lever in communication with said movable foot support to translate stepping motion into a rotational force;

providing a first gear in communication with said lever to translate and amplify said rotational force; and providing a protruding gear to translate said rotational force and turn said hubless wheel.

34. A method as in claim 33, further comprising the step of providing a second gear in communication with said first gear to translate and amplify said rotational force.

35. A method as in claim 33, further comprising the step of providing a tire shield to allow pressure to be placed on said vehicle by a passenger as to provide accurate turning and steering.

* * * * *